United States Patent [19]

Bauer et al.

[11] 4,283,020

[45] Aug. 11, 1981

[54] ELECTRONIC CONTROL SYSTEM FOR RECIPROCATING MECHANISM

[75] Inventors: William A. Bauer, Bel Air; Charles R. Frohlich, Jr., Kingsville; Raymond H. Griffin, Baltimore County; Joseph G. Henderson, Bel Air, all of Md.

[73] Assignee: Western Electric Co., Inc., New York, N.Y.

[21] Appl. No.: 76,003

[22] Filed: Sep. 17, 1979

[51] Int. Cl.[3] ..... B65H 54/28

[52] U.S. Cl. ..... 242/25 R; 242/25 A; 242/158 R; 242/158.4 R

[58] Field of Search ..... 242/25 R, 25 A, 26.2, 242/26.3, 43 R, 43.1, 158 R, 158.2, 158.4 R, 158.4 A

[56] References Cited

U.S. PATENT DOCUMENTS

| | | | |
|---|---|---|---|
| 3,718,846 | 2/1973 | Bejach | 318/85 |
| 3,829,037 | 8/1974 | Sallin | 242/158.2 |
| 3,876,166 | 4/1975 | Kadokura et al. | 242/158.2 |
| 3,877,653 | 4/1975 | Foltyn et al. | 242/25 A |
| 4,083,515 | 4/1978 | Dickerson | 242/158 R |
| 4,130,249 | 12/1978 | Steinhilber | 242/25 R |

*Primary Examiner*—Stanley N. Gilreath
*Attorney, Agent, or Firm*—J. B. Hoofnagle, Jr.

[57] ABSTRACT

An electronic control system (9) controls the movement of a distributer (19) as the distributor guides strand (11) alternately onto reels (12 and 13). Digital signals are generated representing the instantaneous position of the distributor (19) and end-points of travel of the distributor. A controller (38) generates a signal when a coincidence of the instantaneous position of the distributor (19) and alternate ones of the end-points of travel of the distributor occur. The signal is used to reverse the direction of travel of the distributor (19) thus resulting in a uniform distribution of the strand (11) onto the reels (12 and 13). As each of the reels (12 and 13) become full, a signal is generated which causes the distributor (19) to proceed at a high rate of speed toward the back flange of the reel regardless of the direction of travel at that time. This facilitates the cutover of the strand (11) from a full reel to an empty reel.

11 Claims, 2 Drawing Figures

ELECTRONIC CONTROL SYSTEM FOR RECIPROCATING MECHANISM

TECHNICAL FIELD

This invention relates to an electronic control system for a reciprocating mechanism and particularly to an electronic system for controlling a reciprocating distributor used in a high speed strand take-up apparatus.

BACKGROUND OF THE INVENTION

In the winding of strand material onto reels, the material is typically wound onto the reel in layers with each layer containing successive convolutions of the strand material distributed uniformly between front and back flanges of the reel. To prevent undesirable build-up of the strand material at spaced locations on the reel, it is important to control the length-of-travel of a reciprocating strand distributor between the reel flanges.

In one method of controlling the reciprocating strand distributor, a reversible stepper motor drives the distributor between a pair of limit switches which facilitate reversal of the direction of travel of the motor. In this method, the pair of limit switches are spaced to represent the respective ends of the reel. The reciprocating distributor moves adjacent to the reel and distributes the strand material onto the reel until the distributor engages and operates the limit switch at one end of the reel. The stepper motor is then controlled to reverse the direction of travel of the distributor. The distributor travels in the reverse direction while distributing the strand material onto the reel until the distributor engages and operates the limit switches at the other end of the reel. The stepper motor is again controlled to reverse the direction of distributor travel. This pattern of operation continues to provide the reciprocating movement of the distributor. A distributor system employing limit switches is disclosed in U.S. Pat. No. 3,829,037.

Limit switches must be constantly adjusted and checked for malfunction. If the switch becomes defective or if the reciprocating distributor does not properly engage and operate the switch, the distributor may stall in one position near one flange of the reel and cause an undesirable build-up of strand material at this one position.

Another known method of controlling the reciprocating distributor utilizes digital techniques. This system includes a stepper motor to drive the reciprocating distributor adjacent to the reel. Thumbwheel switches are used to establish a count representing the ends of the reel. A rotating pulse generator is fixedly attached to the shaft of the stepper motor to develop a signal representing the distance traveled by the distributor. As the stepper motor rotates, the output of the rotating pulse generator is stored as a count to theoretically represent the instantaneous location of the distributor. Digital circuits are used to compare the stored count with the count established by the settings on the thumbwheel switches. When a coincidence occurs between the stored count and the count of one of the thumbwheel switches, a signal is developed which represents an end-of-travel point of the reciprocating distributor. The stored count increases or decreases depending on whether the reversal of the stepper motor occurred at the front or back flange of the reel. The distributor continues to reciprocate until a full reel of strand material has been attained.

This system is a discrete system. Therefore, if an extraneous pulse occurs, the pulse causes the stored count to indicate an erroneous instantaneous location of the distributor. As a result of the erroneous stored count, the reciprocating distributor is prevented from uniformly distributing strand material between the front and back flange which may cause a build-up of strand material on the reel.

Another method of controlling the reciprocating mechanism using digital techniques is illustrated in U.S. Pat. No. 3,876,166. This method facilitates the winding of the strand material onto bobbins in a package such that the ends of the strand-material package are of a trapezoidal shape. The technique illustrated therein uses a system for producing stroke pulses each time the reciprocating distributor travels a predetermined distance. The number of stroke pulses are counted as the reciprocating mechanism passes a central reference position. The reciprocating distributor is reversed when the number of pulses counted coincides with a setpoint value representing one of two end-of-travel points. The end-of-travel points are automatically sequentially reduced about the central reference position so that the stroke of the reciprocating distributor is gradually reduced to produce the trapezoidal shape at the ends of the strand-material package.

Consequently, there exists a need for a system to accurately control the movement of a reciprocating mechanism to provide for uniform distribution of strand-material being wound onto a reel.

SUMMARY OF THE INVENTION

An electronic system embodying certain principles of the invention for controlling the movement of a reciprocating mechanism between spaced end-points of travel includes means for driving the mechanism. The system further includes means responsive to movement of the driving means for developing a voltage signal representing the instantaneous position of the moving mechanism. Means are provided for establishing voltage levels representing end-of-travel points of the mechanism. Means, responsive to the coincidence of the voltage signal and one of the voltage levels, develops a mechanism reversal signal. Means are provided for applying the reversal signal to the driving means to reverse the direction of travel of the reciprocating mechanism.

The system further includes means for controlling the driving means at the end of a winding cycle to move the mechanism at a relatively high speed to a selected one of the end-of-travel points.

DETAILED DESCRIPTION OF THE INVENTION

In one system (not shown) for the manufacture of an insulated conductor, a conductive rod is advanced from a supply through a wire drawing apparatus and an annealer to form a bare conductor. Subsequently, the bare conductor is advanced through an extruder where a layer of insulating material is extruded about the bare conductor to form the insulated conductor. The insulated conductor is then moved through a cooling medium and finally wound onto reels by facility of a high speed take-up apparatus (not shown).

A system for making insulated conductor similar to that described above is described in U.S. Pat. No. 4,090,896 which, by reference thereto, is incorporated herein.

In the high-speed take-up apparatus, two take-up reels are used and are mounted on spaced parallel axes. Snaggers are positioned near one flange of each reel. At the time when the winding of a full reel has been completed, the insulated conductor is cut over from the full reel to the empty reel. To facilitate the cutover, the insulated conductor being wound onto the full reel is directed to an area near the snagger of the empty reel. A cutover arm is then energized to move the insulated conductor into the snagger of the empty reel. The insulated conductor then severs between the snagger and the full reel and the distributor begins to distribute the conductor onto the empty reel.

A system for transferring from a full reel to an empty reel similar to that described above is described in U.S. Pat. No. 3,877,653 which, by reference thereto, is incorporated herein.

Figure 1:
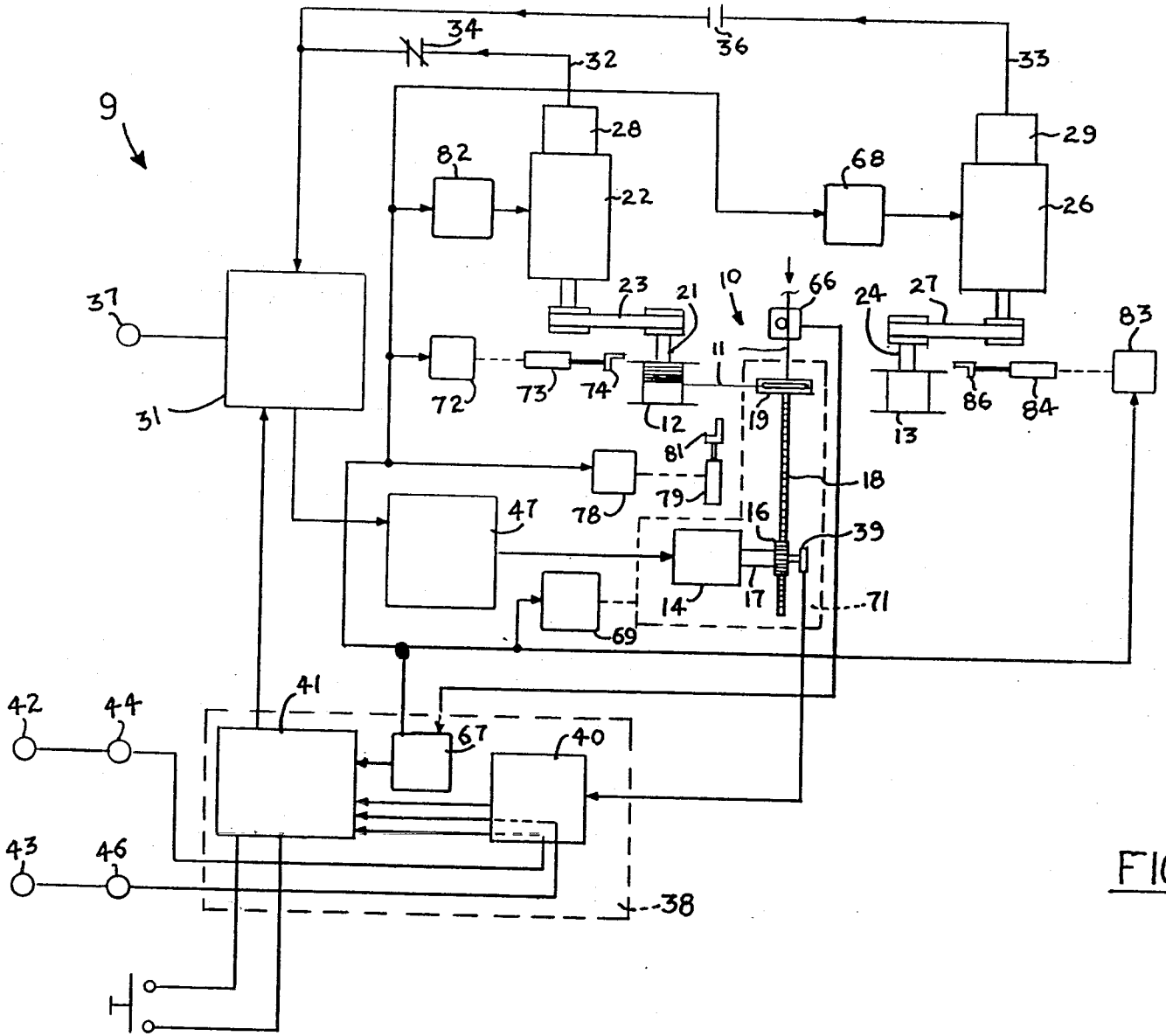
FIG. 1 is a schematic diagram showing an electronic control system embodying certain principles of the invention for controlling the operation of a high speed take-up apparatus.

Referring to FIG. 1, there is illustrated an electronic control system, designated generally by the numeral 9, for controlling a high speed take-up apparatus, designated generally by the numeral 10. The high speed, dual take-up apparatus 10 facilitates the winding of strand material 11, such as insulated conductor, onto a pair of reels 12 and 13. The high speed take-up apparatus 10 is of the type described in U.S. Pat. No. 3,877,653 and includes a reversible stepper motor 14 which has a spur gear 16 fixedly attached to shaft 17 to drive a rack 18 in a reciprocating motion. A reciprocating mechanism, such as distributor 19, is attached to one end of the rack 18 and is positioned between reels 12 and 13. The distributor 19 is reciprocated between front and back flanges of the reels 12 and 13 and guides the strand 11, which is being fed from a strand manufacturing system (not shown), onto take-up reel 12 or 13. The front and back flanges of the reels 12 and 13 represent spaced end-points along the path of travel of the distributor 19. Take-up reel 12 is mounted on arbor 21 which is coupled to reel drive motor 22 by belt 23. Take-up reel 13 is mounted on arbor 24 which is coupled to reel drive motor 26 by belt 27. D.C. tachometers 28 and 29 are attached to drive motors 22 and 26, respectively. The tachometers 28 and 29 alternately generate a high-level voltage signal which is proportional to the speed of drive motors 22 and 26, respectively, and thus each provide a tracking signal for the stepper motor 14.

Both of the D.C. tachometers 28 and 29 are connected to a distributor control circuit, designated generally by numeral 31, by lines 32 and 33, respectively. Relay contacts 34 and 36 located in the lines 32 and 33, respectively, permit only one high-level voltage signal from the tachometers 28 and 29, respectively, to enter the control circuit 31. The control circuit 31, in conjunction with a rate potentiometer 37, proportionally reduces the amplitude of the high-level voltage signal and generates a train of pulses, hereinafter referred to as the pulse signal, to provide a tracking signal for stepper motor 14. Moreover, the control circuit 31 receives two signals from a programmable controller, designated generally by numeral 38, to reverse the stepper motor 14.

The programmable controller 38 which performs in the foregoing manner is commercially available from Industrial Solid State Controls of York, Pennsylvania and is identified as a Programmable Controller Model IPC-300.

A position-feedback potentiometer 39 is attached to shaft 17 of the stepper motor 14 and continuously generates a 0-to-10 volts d.c. analog signal which is representative of the instantaneous position of the distributor 19. The voltage signal is fed into an analog input card 40 which is interfaced with a direction-and-position logic circuit 41 within the controller 38. The analog input card 40 converts the analog voltage signal to a digital signal representative of a number which is within the range of 0 to 255. The digital signal is fed to the controller 38 to permit the continuous monitoring of the instantaneous position of the distributor 19. Varying instantaneous levels of the analog voltage signal represent instantaneous positions of the distributor 19.

The analog input card 40 which performs in the foregoing manner is commercially available from Industrial Solid State Controls of York, Pennsylvania and is identified as Analog Input Module Model 337.

Two manually adjustable potentiometers 42 and 43 are provided to establish analog voltage signals or levels which represent front and back flange reversal end-points of the distributor 19. The analog signals which represent the front and back flange reversal end-points are fed into the programmable controller 38 through the analog input card 40. The analog input card 40 converts the reversal end-point analog voltage signals into digital signals representative of numbers within the range of 0 to 255. The programmable controller 38 is capable of determining the coincidence of value of two digital signals. Therefore, the controller 38 compares the digital signal representing the instantaneous position of the distributor 19 with the digital signal of the applicable reversal end-point and generates the appropriate output signal to the control circuit 31 to reverse the stepper motor 14 and thereby reverse the travel of direction of the distributor 19. As the distributor 19 travels in the reverse direction, the controller 38 continuously monitors the instantaneous position of the distributor. The controller 38 generates the appropriate output signal to the control circuit 31 to reverse the stepper motor 14 when a coincidence of the instantaneous position signal of the distributor and the signal of the other reversal end-point occur. Since this is a dual take-up system utilizing two reels 12 and 13, a separate set of potentiometers 44 and 46 are provided to establish the front and back flange reversal end-points for take-up reel 13.

The pulse signal, developed within the control circuit 31 in response to the input from the appropriate one of the tachometers 28 and 29, is fed to a stepper driver circuit 47. The pulse signal establishes the speed of the stepper motor 14. The stepper motor 14 will rotate 1.8 degrees for each pulse of the pulse signal fed to the stepper driver circuit 47. The frequency of the pulse signal fed to the stepper driver circuit 47 determines the speed of the stepper motor 14 and the distributor 19. The two reversal signals are fed from the controller 38 and coupled through the control circuit 31 to the stepper driver circuit 47. These two signals are processed in the stepper driver circuit 47 and are applied to the stepper motor 14 to reverse the operation of the motor. Stepper motor 14 should only be reversed during the occurrence of the low portion of any pulse of the incoming pulse signal. Therefore, integrated circuits 48 and 49 (FIG. 2) are included in the control circuit 31 to hold the reversal signal until a low portion of the next pulse of the pulse signal occurs.

Integrated circuits 48 and 49 are standard commercially available integrated circuits identified as type SN 7402 and type SN 7406, respectively.

Figure 2:
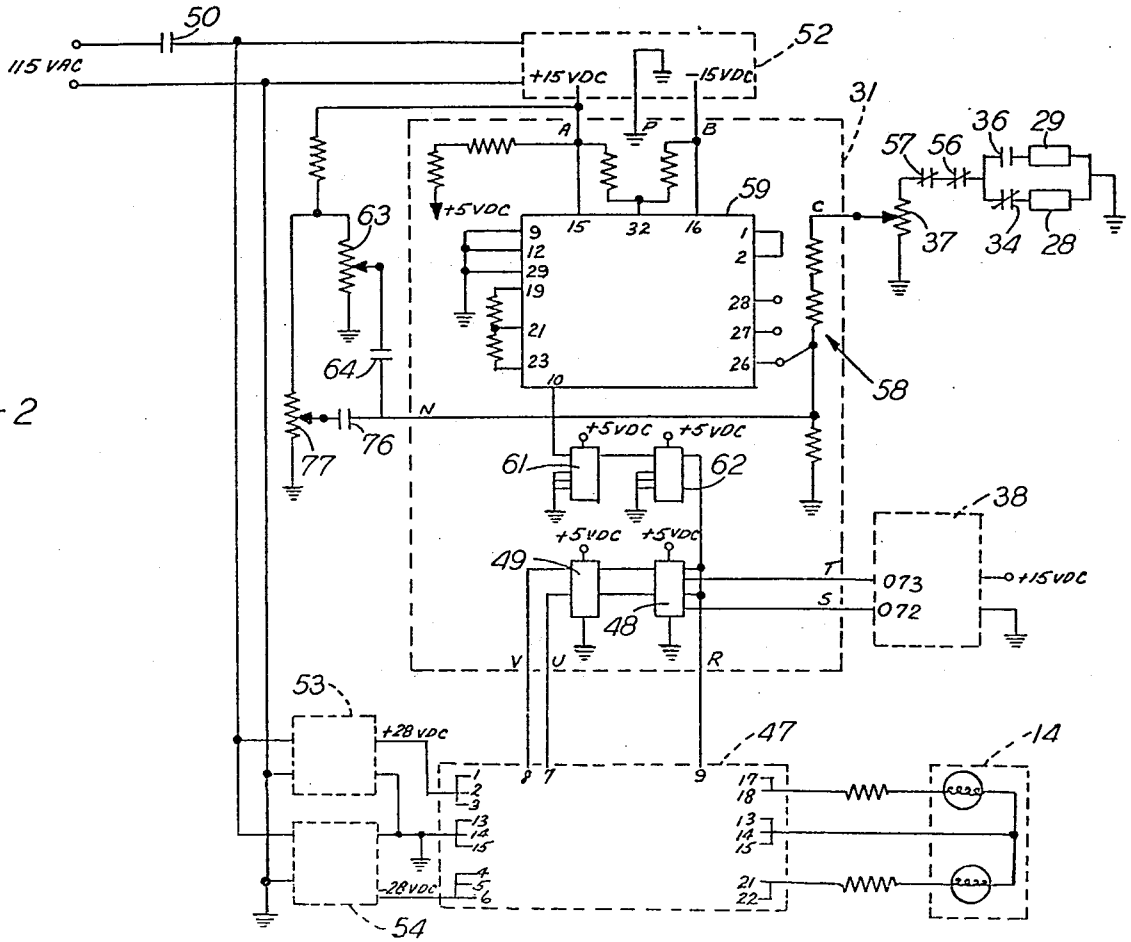
FIG. 2 is a circuit diagram showing portions of the control system of FIG. 1.

As illustrated in FIG. 2, when the system for producing insulated conductor is in operation, the controller 38 facilitates the closure of relay contact 50 to facilitate application of operating power to d.c. power supplies 52, 53 and 54. Power supply 52 is a standard commercially available unit which provides plus and minus 15 volts d.c. power. Power supplies 53 and 54 are standard commercially available units which provide plus and minus 28 volts d.c. power.

As further illustrated in FIG. 2, the high-level voltage signals, generated alternatively by tachometers 28 and 29, are fed to the control circuit 31 through lines 32 and 33, respectively. By selective and alternate closing of the contacts 34 and 36 through the controller 38, only one of the tachometers 28 and 29, respectively, is connected at one time to the control circuit 31. The high-level voltage signal is fed through a pair of series-connected normally closed contacts 56 and 57. Contact 56 is associated with a manual test operation of control system 9. Contact 57 is associated with high-speed operation of the distributor 19. The test and high speed operations take precedence over the tachometer-generated high-level voltage signals by the opening of contacts 56 and 57.

Rate potentiometer 37 is preset to reduce the amplitude of the high-level voltage signal by a factor which is dependent upon the gauge of the strand 11 being wound onto reels 12 and 13. This reduction is accomplished by manual adjustment of the potentiometer 37 by an operator. A voltage divider network 58 within the control circuit 31 further reduces the high-level voltage signal to a proportional 0-to10 volts d.c. analog signal. A voltage-to-frequency converter 59 transforms the proportional analog signal into the pulse signal having a frequency ranging from zero to 10,000 hertz. In the event other tachometers are used which produce negative signals, the converter 59 has provision for inverting the negative signals and applying the inverted signals to the converter. Since the high-level voltage signal generated alternately by tachometers 28 and 29 are proportional to the speed of the reel drive motors 22 and 26, respectively, the pulse signal is used to provide a tracking signal for the stepper motor 14.

The voltage-to-frequency converter 59 which performs in the foregoing manner is commercially available from Datel Systems, Inc. of Canton, Massachusetts and is identified as Universal Voltage-to-Frequency Converter Model VFV-10K.

The maximum 10,000 hertz signal from the converter 59 is much higher than the frequency range of the stepper driver circuit 47. Therefore, the control circuit 31 includes two integrated circuits 61 and 62 which divide by twenty the frequency of the pulse signal. This division of the frequency of the pulse signal permits the converter 59 and the stepper driver circuit 47 to operate over a wider portion of their frequency ranges.

Each of the integrated circuits 61 and 62 is a standard commercially available integrated circuit identified as type SN 7490.

As noted above, the stepper motor 14 should only be reversed when the incoming pulse signal is on a low portion of anyone of a plurality of pulses. Therefore, integrated circuits 48 and 49, as previously discussed, are included in the control circuit 31, to hold the reversal signals, generated by the controller 38, until a low portion of the next pulse of the pulse signal is generated by the converter 59.

The test operation is designed to aid in the setting-up and testing of the electronic control system 9. Test potentiometer 63 allows the operator to operate the distributor 19 at any speed without having the take-up reels 12 and 13 in motion. The test operation is accomplished by the opening of contact 56 and the closing of contact 64. As the setting of test potentiometer 63 is changed, the input voltage level to the converter 59 is modified which, ultimately, modified the speed at which the distributor 19 will travel.

In a more detailed description of the control system 9 as illustrated in FIG. 1, a strand footage counter 66 counts the amount of strand 11 that is being wound onto reels 12 or 13. The counter 66 is manually preset to generate a signal at each of two preset counts which represents (1) near completion of the winding of the strand 11 onto the reels 12 or 13 and (2) the completion of such winding. The count-generated signals are fed to a 110-volt logic circuit 67 which is included in the controller 38. For purposes of discussion, assume that the strand 11 is being wound onto reel 12. When a signal representing the first preset count is fed to the logic circuit 67, a first output signal is generated and is fed to a take-up driver 68. Take-up driver 68 then applies operating power to the reel motor 26 whereby the motor is operated and eventually reaches normal operating speed. Thus, empty reel 13 is now being driven. The first output signal also activates an air motor 69 which is connected to a rod (not shown) protruding through a carriage 71 upon which the distributor 19 is mounted. The air motor 69 rotates the rod and hence moves the carriage 71 above and beyond the reel 13 where the carriage engages and closes a limit switch (not shown). The closing of the limit switch results in the development of a signal within the logic circuit 67 which is fed to and operates solenoid 72. This facilitates operation of air cylinder 73 to move shroud 74 adjacent to the back flange of the full reel 12. The shroud 74 protects the end of the strand 11 from damage once the strand has been severed.

The 110-volt logic circuit 67 which performs in the forgoing manner is commercially available from Industrial Solid State Controls of York, Pennsylvania and is identified as A.C. Input Module Model 330 and A.C. Output Module Model 340.

The counter 66 then generates the second count signal which represents that the winding of a full reel of strand 11 has been accomplished and the strand should be cut over to the empty reel 13. The second count signal is fed to the logic circuit 67 which then feeds a signal to the logic circuit 41. The controller 38, through logic circuit 41, facilitates movement of the distributor 19 at high speed to quickly move the strand 11 toward the back flange of the reel 12. Referring to FIG. 2, this rapid distributor movement is initiated by closing contact 76 and opening contact 57. Upon the closure of contact 76, potentiometer 77 is connected to the converter 59. This alters the potential applied to the converter 59 resulting in the development of a high speed drive signal. The high speed signal is coupled to the stepper driver circuit 47. Regardless of the direction of travel of the distributor 19 at that instant, the high speed signal causes the distributor 19 to travel toward the back flange of reel 12 at a high speed. When the distributor 19 reaches the back flange of reel 12, solenoid 78 is activated for thirteen seconds by the logic circuit 67. Solenoid 78 operates an air cylinder 79 to move a cutover arm 81. The cutover arm 81 engages and moves the portion of the strand 11, which extends between full reel 12 and distributor 19, into a snagger (not shown) associated with empty reel 13. Upon continued rotation of full reel 12, the strand 11 on reel 12 is severed from the snagged portion adjacent to empty reel 13. After the snagging of the strand 11 has taken place, the distributor 19 returns to its normal reciprocating motion at normal operating speed, the full reel motor 22 is deactivated, the carriage 71 moves over the empty reel 13 and the shroud 74 returns to its normal withdrawn position.

A similar type of operation occurs when reel 13 becomes full. The counter 66 generates a first signal which is fed into the logic circuit 67. Logic circuit 67 generates an output signal which is fed to take-up driver 82. Take-up driver 82 starts the reel motor 22 which eventually reaches normal operating speed. The output signal also activates air motor 69 to move the carriage 71 over and beyond reel 12 where the carriage engages and closes a limit switch (not shown). The closure of the limit switch results in the generation of a signal by the logic circuit 67 which is fed to and activates solenoid 83. Activation of solenoid 83 operates air cylinder 84 to move shroud 86 adjacent to the back flange of the the reel 13.

The counter 66 then generates the second count signal which is fed into the logic circuit 67. The distributor 19 is then directed toward the back flange of reel 13 at high speed in the same manner as noted above. When the distributor 19 reaches the back flange of reel 13, solenoid 78 is activated for thirteen seconds by the logic circuit 67. Solenoid 78 operates air cylinder 79 to move the cutover arm 81. The cutover arm 81 engages and moves the strand 11 into a snagger (not shown) adjacent to the empty reel 12. The strand 11 is then severed from the full reel 13 in the manner previously described. The distributor 19 returns to its normal reciprocating motion, the full reel 13 is deactivated, the carriage 71 moves over the empty reel 12 and the shroud 86 returns to its normal withdrawn position.

When the first-count signal is generated by the counter 66, the control system 9 permits the distributor 19 to continue to distribute strand 11 onto the respective one of the reels 12 or 13 at the normal operating speed. The normal operating speed of the distributor 19 continues thereafter until the second-count signal is generated by the counter 66. This provides for continued even distribution of the strand 11 during a final period of the strand-winding cycle and results in a more uniform appearing strand package.

Generation of the second-count signal by the counter 66 provides indication that the respective one of the reels 12 or 13 is full. At this time, it is important that the strand 11 be cut over to the empty reel as quickly as possible in order to minimize overlengths of strand 11 being wound onto the full reel. As noted above, regardless of the direction of travel of the distributor 19 at the instant of generation of the second-count signal, the distributor is moved rapidly to the back flange in preparation for cut over of the strand 11 from the full reel to the empty reel thereby minimizing overlengths. Additionally, movement of the distributor 19 places the strand 11 at the back flange of the empty reel which optimizes the probability of the snagging of the strand during cutover.

Counter 66 is commercially available from Dynapar Corporation of Gurnee, Illinois as Model 524 Digital Electronic Counter.

Appendices I, II and III are appendages to this specification and relate to the logic of the controller 38. Appendix I is a "Ladder Listing" which reveals, on a line number basis, relay and contact logic as connected within the controller 38 to facilitate the operational control of the take-up apparatus 10. Appendix II is an "Input-Output Address Listing" which lists (1) the functions in abbreviated expression, (2) the input-output address and (3) the "ladder listing" line number indicating the location of contacts and, where appropriate, coils associated with the functions. Appendix III is a "Glossary of Function Definitions" which briefly defines the abbreviated expressions of Appendices I and II.

In Appendix II, the input-output addresses which do not contain a listed function, represent logic internal to the controller 38 which is necessary to provide control for the take-up apparatus 10.

In Appendix I, the "( )" symbol represents the coil of a relay. The "[ ]" symbol represents an open contact of either a switch or a relay and the "[✓]" symbol represents a closed contact. The symbol "[D]" represents that, internally of the controller 38, the analog I/O address 87 (see Appendix II) has been instructed to provide data to a particular memory location for storage awaiting later recall. The symbol "(S)" represents that data from address 87 is to be stored in a memory location whose address is listed immediately above the symbol. The symbol "[B]" represents that data stored in the memory location address listed above the symbol is brought back, or recalled, for a particular purpose. The symbol "[G]" represents the expression "greater than or equal to."

The line numbers of the ladder are illustrated in the left margin of each sheet. A number is assigned to each relay coil and the functional expression also appears adjacent to those relays associated with control of facilities external of the controller 38. The associated relay contacts also contain the same number and functional expression designations. The box enclosures, with expressions "TRO" and "RST", appearing throughout Appendix I (see line 5) represent delay timers which operate after a preset delay and then reset. The time period of the present delay is listed next to the box enclosure following expression "PRS". The expression "SKP", with the numeral "1" listed immediately below the expression, represents that the next succeeding line function of the "Ladder Listing" is to be skipped. If the numeral "3" follows the expression, the next three line functions are to be skipped.

With particular reference to Appendices I and II, and also to FIGS. 1 and 2, the following is a description of that portion of the "Ladder Listing" which relates (1) to control of the reversal of the distributor 19 to effect the reciprocating motion and (2) to the control of the distributor for the high speed movement thereof to the back flange of either of the reels 12 or 13. It is to be understood that in the description reference to line numbers refers to the line numbers appearing in the left margin of each sheet of the "Ladder Listing." Further, reference to an address number refers to the I/O address appearing in the left margin of the "Input/Output Address Listing." Also, coil symbols are referred to as "outputs."

Initially, the end-points of travel of the distributor 19 are established by the setting of potentiometers 42, 43, 44 and 46 (FIG. 1) which provide analog outputs as previously described. The data embodied in these settings is applied to addresses 81, 82, 83 and 84 which represent right reel front flange, right reel back flange, left reel front flange and left reel back flange, respectively. When the distributor 19 is in operation, the constantly changing data from the position-feedback potentiometer 39 is applied to address 80.

The input data at addresses 81 (right front flange) and 83 (left front glange) will appear as inputs on lines 114 and 116, respectively. These inputs will be reflected on line 120 where, internally of the controller 38, analog address 87 provides a data signal to internal memory of the controller to be stored at address 240. The input data at addresses 82 (right back flange) and 84 (left back flange) will appear as inputs on lines 122 and 124, respectively. These inputs will be reflected on line 128 where, internally of the controller 38, analog address 87 provides a data signal to internal memory of the controller to be stored at address 250. The constantly changing input data at address 80, which represents the instantaneous position of the distributor 19, will appear as an input on line 106. This input will be reflected on line 112 where, internally of the controller 38, analog address 87 provides a data signal to internal memory of the controller to be stored at address 230.

For the purposes of this description, reel 13 will be the right reel and reel 12 will be the left reel. If strand 11 is being taken up on the right reel 13, inputs of addresses 81 and 82 are used. If strand 11 is being taken up on the left reel 12, inputs of addresses 83 and 84 are used. When the strand 11 is being taken up on the right reel 13, normally open contacts 41 in lines 113 and 121 deactivate the SKP/1 function on those lines so that the respective next succeeding functions will occur. These respective next succeeding functions are the inputs of addresses 81 (right front flange) and 82 (right back flange). At the same time, normally closed contacts 41 in lines 115 and 123 facilitate the skipping of the functions on lines 116 and 124, respectively. These functions are the inputs of addresses 83 (left front flange) and 84 (left back flange). Consequently, while the right reel 13 is being used, the end-points data associated with the left reel 12 is not used. When the left reel 12 is used, the above-mentioned contacts 41 are reversed so that end-points data associated with the left reel is used.

The selection of one of the reels 12 or 13 is established within the controller 38 as described above. Once this reel selection has been established, the controller 38 provides common distributor reversal instructions regardless of whether reel 12 or 13 is being used. Therefore, the following description will relate only to the reversal of the distributor 19 and not to a particular one of the reels 12 and 13.

In controlling the reversal of the distributor 19 at the front flange of either of the reels 12 or 13, a front-flange reversal calculation is performed on line 129. The front-flange reference potentiometers 42 and 44 are set to produce a large number, such as 250. The distributor position-feedback potentiometer 39 produces a constantly changing signal as the distributor 19 moves over the reel. As the distributor 19 moves toward the front flange, the position-feedback potentiometer 39 is producing an increasing number within the range of zero to 255. When the feedback number becomes greater than or equal to, the front flange reference number, then output 190 (line 129) is turned on. A contact of output 190, appearing in line 130, causes output 72 to be energized, which changes the signal at output address 72 from plus five volts d.c. to zero volts d.c. A similar calculation takes place on line 131 for the back-flange reversal, except the back-flange reference potentiometers 43 and 46 are set to produce a low number, such as 5. When output 191 on line 131 is turned on in response to the reversal calculation, output 73 is energized to change the signal at output address 73 to effect reversal of the distributor 19 at the back flange.

When the footage counter 66 reaches the second preset count, contact 65 in line 141 is closed to pulse output 197. Contacts 197, in line 142, are closed to operate a delay timer which, after one-tenth of a second, pulses output 198. Also, when output 197 is pulsed, contact 197 in line 143 is closed to facilitate the pulsing of output 199. Line 143 also contains a normally-closed contact of output 198 which is opened after the one-tenth of a second delay imposed by the delay timer in line 142. This results in momentary pulsing of output 199. At that time, a contact 199 in line 130 causes the distributor 19 to immediately travel toward the back flange in the event that the distributor had been traveling toward the front flange. If the distributor 19 had already been traveling toward the back flange, contacts 192 in line 130 would have been previously opened and the closure of contact 199 would have no effect. At the time of momentary pulsing of output 199, a contact 199 in line 144 turns on output 57. When output 57 is turned on, contact 57 (FIG. 2) is opened and contact 76 (FIG. 2) is closed which causes the distributor 19 to operate at the high rate of speed as previously described. When the distributor 19 reaches the back flange, a contact of output 191 is closed in line 145 to energize output 200. The energizing of output 200 results in the triggering of all of the final cutover functions as previously described and returns the control system 9 to its normal operation, now under control of the empty reel.

REF #401011

APPENDIX I

LADDER LISTING

```
LINE
NUMBER
   0  ! BEGIN OF MEM
      !
   1  !  TEST                                                          TEST
      !  255                                                            255
      !--]/[--+-----------------------------------------------------------( )--
      !
   2  ! RESET   CARFL   CADRR                                          CAPOS
      !    0       4       5                                             100
      !--] [--+--] [--+--] [--+-------------------------------------------( )--
      !       !       !
      !       ! CAPOS !
      !       !  100  !
      !       +--] [--+
      !
   3  ! RESET   CADRR   RCLMP                                          TREDY
      !    0       5      15     187                                     58
      !--] [--+--]/[--+--]/[--+--]/[--+-------------------------------------( )--
      !       !                 !
      !       ! TREDY           !
      !       !   58            !
      !       +--] [----------+
      !
   4  ! RESET     RUN   LDRVE   RDRVS            RCLMP            RDRVE
      !    0       1      32      33     122      15               33
      !--] [--+--] [--+--]/[--+--] [--+--]/[--+--]/[--+----------( )--
      !                 !       !       !
      !                 ! CPULS !       !
      !                 !  108  !  188  !
      !                 +--]/[--+--] [--+
      !                 !       !       !
      !                 !       !       !
      !                 !  113  !  113  !
      !                 +--] [--+--]/[--+
      !
   5  ! RDRVE
      !   33            +-----+                                          208
      !--]/[--+-------! IRO !-+-----------------------------------------( )--
      !                 !     !
      ! RDRVE           !     !
      !   33            !     !
      !--]/[--+-------! RST ! PRS   13
      !                 !     ! ACC    0
      !                 !     !
      !                 !     !
      !                 !     !
      !                 +-----+
      !
   6  ! RESET     RUN            MACUT            RCLMP   LCLMP   MANCT
      !    0       1     188       2     200      15      16     101
      !--] [--+--] [--+--]/[--+--] [--+--]/[--+--]/[--+--]/[--+--( )--
      !                 !       !
      !                 ! MANCT !
      !                 !  101  !
      !                 +--] [----------+
      !
```

```
LINE
NUMBER
   7  ! RESET      RUN    CARFL    MANCT
      !    0        1       4      101                                  102
      !--] [--+--] [--+--] [--+--] [--+-------------------------------( )--
      !                 !       !
      !                 ! CARFR !
      !                 !    3  !
      !                 +--] [--+
      !
   8  !                                                              MANCT
      !  102            +------+                                      103
      !--] [--+-------! TRO !-+-----------------------------------( )--
      !                 !      !
      !                 !      !
      !  102            !      !
      !--] [--+-------! RST ! PRS  4.0
      !                 !      ! ACC   .0
      !                 !      !
      !                 !      !
      !                 !      !
      !                 +------+
      !
   9  ! RESET      RUN    1PRST                                     RMODE
      !    0        1      31      206                                105
      !--] [--+--] [--+--] [--+--]/[--+-------------------------------( )--
      !                 !       !
      !                 ! RMODE !
      !                 !  105  !
      !                 +--] [--+
      !                 !       !
      !                 ! MANCT !
      !                 !  101  !
      !                 +--] [--+
      !
  10  ! RESET      RUN            CARFL    RCLMP    LCLMP            CUTOV
      !    0        1      204      4       15       16                35
      !--] [--+--] [--+--] [--+--] [--+--]/[--+--]/[--+----------( )--
      !                        !       !
      !                        ! CARFR !
      !                        !    3  !
      !                        +--] [--+
  11  ! RESET      RUN              OFF    CARFR                      CPULS
      !    0        1      200     107       3                        106
      !--] [--+--] [--+--] [--+--]/[--+--] [--+-----------------( )--
      !                 !       !        !       !
      !                 ! CPULS !        ! CARFL !
      !                 !  106  !        !    4  !
      !                 +--] [--+        +--] [--+
      !                                  !       !
      !                                  ! CPULS !
      !                                  !  106  !
      !                                  +--] [--+
      !
  12  ! CPULS                                                          OFF
      !  106            +------+                                      107
      !--] [--+-------! TRO !-+-----------------------------------( )--
      !                 !      !
      ! CPULS           !      !
      !  106            !      !
      !--] [--+-------! RST ! PRS  1.0
      !                 !      ! ACC   .0
      !                 !      !
      !                 !      !
      !                 !      !
      !                 +------+
```

```
LINE
NUMBER

     :
 13  : RESET      RUN    CUTOV      OFF                                  CPULS
     :    0         1       35      109                                   108
     :--] [--+--] [--+--] [--+--]/[--+-------------------------------( )--
     :                  :        :
     :                  : CPULS  :
     :                  :  108   :
     :                  +--] [--+
     :
 14  : CPULS                                                              OFF
     :  108            +------+                                          109
     :--] [--+--------: TRO  :-+-----------------------------------( )--
     :                 :      :
     : CPULS           :      :
     :  108            :      :
     :--] [--+--------: RST  : PRS    .5
     :                 :      : ACC    .0
     :                 :      :
     :                 :      :
     :                 :      :
     :                 +------+
     :
 15  : RESET      RUN    CPULS      OFF                                  CTARM
     :    0         1      108      110                                    40
     :--] [--+--] [--+--] [--+--]/[--+-------------------------------( )--
     :                  :        :
     :                  : CTARM  :
     :                  :   40   :
     :                  +--] [--+
     :
 16  : CTARM                                                              OFF
     :   40            +------+                                          110
     :--] [--+--------: TRO  :-+-----------------------------------( )--
     :                 :      :
     : CTARM           :      :
     :   40            :      :
     :--] [--+--------: RST  : PRS 13.0
     :                 :      : ACC    .0
     :                 :      :
     :                 :      :
     :                 :      :
     :                 +------+
     :
 17  : RESET      RUN    CUTOV
     :    0         1       35      113                                   111
     :--] [--+--] [--+--] [--+--]/[--+-------------------------------( )--
     :                  :        :
     :                  :        :
     :                  :  111   :
     :                  +--] [--+
     :
 18  :
     :  111            +------+                                          112
     :--] [--+--------: TRO  :-+-----------------------------------( )--
     :                 :      :
     :                 :      :
     :  111            :      :
     :--] [--+--------: RST  : PRS   1.0
     :                 :      : ACC    .0
     :                 :      :
     :                 :      :
     :                 :      :
     :                 +------+
```

```
LINE
NUMBER
  19  RESET      RUN
        0         1      112      115                                113
      --] [--+--] [--+--] [--+--]/[--+-------------------------------( )--
                          |        |
                          |        |
                          |  113   |
                          +--] [--+

  20  RESET      RUN    CUTOV
        0         1      35      113                                114
      --] [--+--] [--+--] [--+--] [--+-------------------------------( )--
                          |        |
                          |        |
                          |  114   |
                          +--] [--+

  21
        114               +------+
      --] [--+----------- | TRO  |-+-----------------------------------( )--
                          |      |                                     115
                          |      |
        114               |      |
      --] [--+----------- | RST  | PRS   1.0
                          |      | ACC    .0
                          |      |
                          +------+

  22  RESET      RUN    RDRVE    LDRVE            LCLMP            LDRVE
        0         1      33       32      125      16               32
      --] [--+--] [--+--]/[--+--] [--+--]/[--+--]/[--+-----------( )--
                          |        |        |
                          | CPULS  |        |
                          |  108   |  188   |
                          +--]/[--+--] [--+
                          |        |        |
                          |        |        |
                          |  113   |  113   |
                          +--]/[--+--] [--+

  23  LDRVE
        32                +------+
      --]/[--+----------- | TRO  |-+-----------------------------------( )--
                          |      |                                     209
                          |      |
      LDRVE               |      |
        32                |      |
      --]/[--+----------- | RST  | PRS    13
                          |      | ACC     0
                          |      |
                          |      |
                          +------+

  24  RESET    CARFL    CADRR    T11CR    CAPOS            CPULS    CARRL
        0        6        5       41      100      152      106       36
      --] [--+--] [--+--] [--+--]/[--+--]/[--+--]/[--+--]/[--+--( )--
                          |        |
                          |        |
                          |  188   |
                          +--] [--+
```

```
LINE
NUMBER
  25  ! RESET      RUN    CARFL            MANCT
      !    0        1       4      118      101                          116
      !--] [--+--] [--+--] [--+--]/[--+--] [--+------------------( )--
      !                                  !        !
      !                                  !        !
      !                                  !  116   !
      !                                  +--] [--+
      !
  26  ! RESET      RUN    CARFL
      !    0        1       4                                            117
      !--] [--+--] [--+--] [--+-----------------------------------( )--
      !
  27  !
      !  117            +-----+                                          118
      !--] [--+-------! TRD !-+-----------------------------------( )--
      !                 !     !
      !                 !     !
      !  117            !     !
      !--] [--+-------! RST ! PRS  5.0
      !                 !     ! ACC   .0
      !                 !     !
      !                 !     !
      !                 !     !
      !                 +-----+
      !
  28  ! RESET    CPULS
      !    0      108     120     113                                    119
      !--] [--+--] [--+--]/[--+--]/[--+-------------------------( )--
      !
  29  ! RESET    CPULS
      !    0      108     119     113                                    120
      !--] [--+--] [--+--]/[--+--] [--+-------------------------( )--
      !
  30  ! RESET      RUN                                                  T11CR
      !    0        1     119     120                                     41
      !--] [--+--] [--+--] [--+--]/[--+-------------------------( )--
      !                 !       !
      !                 ! T11CR !
      !                 !   41  !
      !                 +--] [--+
      !
  31  !
      !  119     123                                                    121
      !--] [--+--]/[--+-------------------------------------------( )--
      !       !
      !       !
      !  121  !
      !--] [--+
      !
  32  !
      !  121            +-----+                                          122
      !--] [--+-------! TRD !-+-----------------------------------( )--
      !                 !     !
      !                 !     !
      !  121            !     !
      !--] [--+-------! RST ! PRS   .1
      !                 !     ! ACC   .0
      !                 !     !
      !                 !     !
      !                 !     !
      !                 +-----+
      !
```

```
LINE
NUMBER
  33  !
      !  122            +-----+                                          123
      !--] [--+-------! TRD !-+-----------------------------------( )--
      !                !     !
      !                !     !
      !  122           !     !
      !--] [--+-------! RST ! PRS  2.0
      !                !     ! ACC   .0
      !                !     !
      !                !     !
      !                !     !
      !                +-----+
      !
  34  !
      !  120     126                                                     124
      !--] [--+--]/[--+-----------------------------------------( )--
      !        !
      !        !
      !  124   !
      !--] [--+
      !
  35  !
      !  124            +-----+                                          125
      !--] [--+-------! TRD !-+-----------------------------------( )--
      !                !     !
      !                !     !
      !  124           !     !
      !--] [--+-------! RST ! PRS   .1
      !                !     ! ACC   .0
      !                !     !
      !                !     !
      !                !     !
      !                +-----+
      !
  36  !
      !  125            +-----+                                          126
      !--] [--+-------! TRD !-+-----------------------------------( )--
      !                !     !
      !                !     !
      !  125           !     !
      !--] [--+-------! RST ! PRS  2.0
      !                !     ! ACC   .0
      !                !     !
      !                !     !
      !                !     !
      !                +-----+
      !
  37  ! RESET   ARMSP   RRSET   LRSET   RARMD   RLOAD   LLOAD   ARMSP
      !    0      70      71      30      17      27      29     127
      !--] [--+--] [--+--]/[--+--]/[--+--]/[--+--]/[--+--]/[--+--( )--
      !        !       !                !       !
      !        ! ARMSP !                ! LARMD !
      !        !  127  !                !   18  !
      !        +--] [--+                +--]/[--+
      !
  38  ! RESET     RUN   CARFL   LSARD                                   RSHRD
      !    0       1      4      39                                      38
      !--] [--+--] [--+--] [--+--]/[--+-------------------------( )--
      !                !       !
      !                ! CTARM !
      !                !  40   !
      !                +--] [--+
      !
```

```
LINE
NUMBER
 39   RESET     RUN    RSHRD              ARMSP    RARMU    RDRVE
        0        1      10      188       127       68       33      128
      --] [--+--] [--+--] [--+--]/[--+--]/[--+--] [--+--]/[--+--( )--
                 MANUR
                   9
                +--] [--+--------+
                 146
                +--] [--+
                 128
                +--] [--+

 40   RESET    CTARM            RCONF    RDRVE    LARMU    LARMD    RARMU
        0       40      128      52       33       43       49      104
      --] [--+--]/[--+--] [--+--]/[--+--]/[--+--]/[--+--]/[--+--( )--
                          RLOAD
                            27
                          +--] [--+

 41   RARMU    RARMU    RARMD                                      RARMU
      104       68       48                                          42
      --] [--+--] [--+--]/[--+-------------------------------------( )--

 42   RESET    RARMU            RDRVE                                RUNCL
        0       13      149      33      208                         44
      --] [--+--] [--+--]/[--+--]/[--+--] [--+-------------------( )--
                 RUNCL
                   44
                +--] [--+

 43   RESET    RCLMP
        0       15  +------+                                        129
      --] [--+--] [--: TRD :-+-----------------------------------( )--
                  :      :
      RESET    RCLMP :      :
        0       15  :      :
      --] [--+--] [--: RST : PRS   3.0
                  :      : ACC    .0
                  +------+

 44   RESET    RCLMP                                                RPUSH
        0       15      129                                         46
      --] [--+--] [--+--]/[--+-------------------------------------( )--

 45
      129           +------+                                        130
      --] [--+-------: TRD :-+-----------------------------------( )--
                     :      :
      129            :      :
      --] [--+-------: RST : PRS   1.0
                     :      : ACC    .0
                     +------+
```

```
LINE
NUMBER
 46   129      130                                                    131
      --] [--+--]/[--+-------------------------------------------( )--

 47   RESET    RRSET    RARMD    RDRVE    ARMSP    LARMD    LARMU    RARMD
        0       71       17       33      127       49       43      202
      --] [--+--] [--+--] [--+--]/[--+--]/[--+--]/[--+--]/[--+--( )--
                 RARMD
                   48
                 +--] [--+
                  150
                 +--] [--+
                  131
                 +--] [--+

 48   RARMD    RARMU                                                  RARMD
       202       42                                                     48
      --] [--+--]/[--+-------------------------------------------( )--

 49   RESET    RARMU    RCLMP    RARMD                                 1CYRT
        0       42       15       48                                   132
      --] [--+--] [--+--]/[--+--]/[--+-------------------------( )--
                 1CYRT
                  132
                 +--] [----------+

 50   RESET    RARMU    RCLMP    RARMD                                 2CYRT
        0       42       15       48                                   133
      --] [--+--] [--+--] [--+--]/[--+-------------------------( )--
                 2CYRT
                  133
                 +--] [----------+

 51   RESET    1CYRT    RCONF    RARMU
        0      132       52       42      135                          134
      --] [--+--] [--+--]/[--+--]/[--+--]/[--+-------------------( )--
                  134
                 +--] [--+

 52   RESET    RRSET    RARMD
        0       71       17                                            135
      --] [--+--] [--+--] [--+-------------------------------( )--
                  135
                 +--] [--+

 53   RESET    RARMD
        0       66      134                                            136
      --] [--+--] [--+--] [--+-------------------------------( )--
```

```
LINE
NUMBER
 54  !
     !  136            +-----+                                        137
     !--] [--+-------! TRO !-+-----------------------------------( )--
     !                !     !
     !                !     !
     !  136           !     !
     !--] [--+-------! RST ! PRS  2.0
     !                !     ! ACC   .0
     !                !     !
     !                !     !
     !                !     !
     !                +-----+
     !
 55  !
     !  137            +-----+                                        138
     !--] [--+-------! TRO !-+-----------------------------------( )--
     !                !     !
     !                !     !
     !  137           !     !
     !--] [--+-------! RST ! PRS  9.0
     !                !     ! ACC   .0
     !                !     !
     !                !     !
     !                !     !
     !                +-----+
     !
 56  !                                                            RRWND
     !  137     138                                                 50
     !--] [--+--]/[--+-----------------------------------------( )--
     !
 57  !
     !  138            +-----+                                        139
     !--] [--+-------! TRO !-+-----------------------------------( )--
     !                !     !
     !                !     !
     !  138           !     !
     !--] [--+-------! RST ! PRS  2.0
     !                !     ! ACC   .0
     !                !     !
     !                !     !
     !                !     !
     !                +-----+
     !
 58  ! RESET   RINDX            RARMU   RARMD
     !    0      21      143      42      48                         140
     !--] [--+--] [--+--]/[--+--]/[--+--]/[--+-----------------( )--
     !        !        !
     !        !        !
     !        !  140   !
     !        +--] [--+
     !        !        !
     !        !        !
     !        !  139   !
     !        +--] [--+
     !
 59  !                                                            RCONF
     !  140     142                                                 52
     !--] [--+--]/[--+-----------------------------------------( )--
     !
```

```
LINE
NUMBER
 60  !
     !  140            +-----+
     !--] [--+-------! TRO !-+-----------------------------------( )--  141
     !                !     !
     !                !     !
     !  140           !     !
     !--] [--+-------! RST ! PRS  5.0
     !                !     ! ACC   .0
     !                !     !
     !                !     !
     !                !     !
     !                +-----+
     !
 61  !
     !  141                                                          RCOND
     !--] [--+-------------------------------------------------------( )--  54
     !
 62  !
     !  141            +-----+
     !--] [--+-------! TRO !-+-----------------------------------( )--  142
     !                !     !
     !                !     !
     !  140           !     !
     !--] [--+-------! RST ! PRS  3.0
     !                !     ! ACC   .0
     !                !     !
     !                !     !
     !                !     !
     !                +-----+
     !
 63  !
     !  142            +-----+
     !--] [--+-------! TRO !-+-----------------------------------( )--  143
     !                !     !
     !                !     !
     !  140           !     !
     !--] [--+-------! RST ! PRS  5.0
     !                !     ! ACC   .0
     !                !     !
     !                !     !
     !                !     !
     !                +-----+
     !
 64  ! RESET   RINDX   RARMU   RARMD
     !   0      21      42      48      145
     !--] [--+--] [--+--]/[--+--]/[--+--]/[--+-----------------( )--  144
     !       !       !
     !       !       !
     !       ! 144   !
     !       +--] [--+
     !
 65  !
     !  144            +-----+
     !--] [--+-------! TRO !-+-----------------------------------( )--  145
     !                !     !
     !                !     !
     !  144           !     !
     !--] [--+-------! RST ! PRS 20.0
     !                !     ! ACC   .0
     !                !     !
     !                !     !
     !                !     !
     !                +-----+
     !
```

```
LINE
NUMBER
 66  ! RESET
     !    0      143      144                                          146
     !--] [--+--] [--+--]/[--+-----------------------------------------( )--
     !
 67  ! RARMD   2CYRT
     !   48     133      151                                          147
     !--]/[--+--] [--+--]/[--+-----------------------------------------( )--
     !                 !
     !           RESET !
     !  147        0  !
     !--] [--+--] [--+
     !
 68  ! RESET   RARMU
     !    0      13      151                                          148
     !--] [--+--] [--+--]/[--+-----------------------------------------( )--
     !        !        !
     !        !        !
     !        !  148   !
     !        +--] [--+
     !
 69  ! RESET   RARMU
     !    0      13      148      147                                 149
     !--] [--+--] [--+--] [--+--] [--+-----------------------------------( )--
     !        !        !
     !        !        !
     !        !  149   !
     !        +--] [--+
     !
 70  !
     !  149            +------+                                        150
     !--] [--+-------! TRO !-+-----------------------------------------( )--
     !                !      !
     !                !      !
     !  149           !      !
     !--] [--+-------! RST !  PRS   2.0
     !                !      !  ACC    .0
     !                !      !
     !                !      !
     !                !      !
     !                +------+
     !
 71  !
     !  150            +------+                                        151
     !--] [--+-------! TRO !-+-----------------------------------------( )--
     !                !      !
     !                !      !
     !  150           !      !
     !--] [--+-------! RST !  PRS   2.0
     !                !      !  ACC    .0
     !                !      !
     !                !      !
     !                !      !
     !                +------+
     !
 72  ! RESET   CARFR     RUN   CAPOS   CAORR            CPULS   CARRR
     !    0       8       1     100       5     116      106      37
     !--] [--+--] [--+--]/[--+--] [--+--] [--+--]/[--+--]/[--+--( )--
     !                 !                 !        !
     !                 ! CAOLR   T11CR ! CAPOS !
     !                 !    7      41  !  100  !
     !                 +--] [--+--] [--+--]/[--+
     !                 !        !
     !                 !        !
     !                 !  188   !
     !                 +--] [--+
```

```
LINE
NUMBER
 73  RESET     RUN    CARFR            MANCT
       0        1       3     154      101                          152
     --] [--+--] [--+--] [--+--]/[--+--] [--+------------------( )--
                                  !       !
                                  !       !
                                  !  152  !
                                  +--] [--+

 74  RESET     RUN    CARFR
       0        1       3                                           153
     --] [--+--] [--+--] [--+-------------------------------------( )--

 75
       153          +-----+                                        154
     --] [--+-------! TRD !-+-------------------------------------( )--
                    !     !
                    !     !
       153          !     !
     --] [--+-------! RST ! PRS  5.0
                    !     ! ACC   .0
                    !     !
                    !     !
                    +-----+

 76  RESET     RUN    CARFR   RSHRD                                LSHRD
       0        1       3      38                                   39
     --] [--+--] [--+--] [--+--]/[--+-------------------------( )--
                    !     !
                    ! CTARM !
                    !  40  !
                    +--] [--+

 77  RESET     RUN    LSHRD            ARMSP   LARMU   LDRVE
       0        1      12     188      127      69      32      155
     --] [--+--] [--+--] [--+--]/[--+--]/[--+--] [--+--]/[--+--( )--
                    !     !
                    ! MANUL !
                    !  11  !
                    +--] [--+-------+
                    !     !
                    !     !
                    ! 155  !
                    +--] [--+
                    !     !
                    !     !
                    ! 173  !
                    +--] [--+

 78  RESET   CTARM          LCONF   LDRVE   RARMU   RARMD   LARMU
       0      40     155     53      32      42      48      179
     --] [--+--]/[--+--] [--+--]/[--+--]/[--+--]/[--+--]/[--+--( )--
                    !     !
                    ! LLOAD !
                    !  29  !
                    +--] [--+

 79  LARMU   LARMU   LARMD                                         LARMU
     179      69      49                                            43
     --] [--+--] [--+--]/[--+-------------------------------------( )--
```

```
LINE
NUMBER
 80  ! RESET   LARMU            LDRVE                                  LUNCL
     !    0      14      176      32      209                           45
     !--] [--+--] [--+--]/[--+--]/[--+--] [--+-----------------------( )--
     !        !        !
     !        ! LUNCL !
     !        !   45  !
     !        +--] [--+
     !
 81  ! RESET   LCLMP
     !    0      16  +-----+                                           156
     !--] [--+--] [--! TRD !-+-----------------------------------( )--
     !                !     !
     ! RESET   LCLMP !     !
     !    0      16  !     !
     !--] [--+--] [--! RST ! PRS  3.0
     !                !     ! ACC   .0
     !                !     !
     !                !     !
     !                !     !
     !                +-----+
     !
 82  ! RESET   LCLMP                                                   LPUSH
     !    0      16     156                                             47
     !--] [--+--] [--+--]/[--+-----------------------------------( )--
     !
 83  !
     !  156           +-----+                                          157
     !--] [--+-------! TRD !-+-----------------------------------( )--
     !                !     !
     !                !     !
     !  156           !     !
     !--] [--+-------! RST ! PRS  1.0
     !                !     ! ACC   .0
     !                !     !
     !                !     !
     !                !     !
     !                +-----+
     !
 84  !
     !  156     157                                                    158
     !--] [--+--]/[--+-----------------------------------------( )--
     !
 85  ! RESET   LRSET   LARMD   LDRVE   ARMSP   RARMD   RARMU   LARMD
     !    0      30      18      32     127      48      42     203
     !--] [--+--] [--+--] [--+--]/[--+--]/[--+--]/[--+--]/[--+--( )--
     !        !        !
     !        ! LARMD !
     !        !   49  !
     !        +--] [--+
     !        !        !
     !        !        !
     !        !  177  !
     !        +--] [--+
     !        !        !
     !        !        !
     !        !  158  !
     !        +--] [--+
     !
 86  ! LARMD   LARMU                                                   LARMD
     !  203      43                                                     49
     !--] [--+--]/[--+-----------------------------------------( )--
     !
```

```
LINE
NUMBER
 87  ! RESET   LARMU   LCLMP   LARMD                                  1CYLT
     !    0      43      16      49                                    159
     !--] [--+--] [--+--]/[--+--]/[--+-------------------------------( )--
     !       !                 !
     !       ! 1CYLT           !
     !       !  159            !
     !       +--] [----------+
     !
 88  ! RESET   LARMU   LCLMP   LARMD                                  2CYLT
     !    0      43      16      49                                    160
     !--] [--+--] [--+--] [--+--]/[--+-------------------------------( )--
     !       !                 !
     !       ! 2CYLT           !
     !       !  160            !
     !       +--] [----------+
     !
 89  ! RESET   1CYLT   LCONF   LARMU
     !    0     159      53      43     162                           161
     !--] [--+--] [--+--]/[--+--]/[--+--]/[--+----------------------( )--
     !       !       !
     !       !       !
     !       !  161  !
     !       +--] [--+
     !
 90  ! RESET   LRSET   LARMD
     !    0      30      18                                            162
     !--] [--+--] [--+--] [--+------------------------------------( )--
     !       !       !
     !       !       !
     !       !  162  !
     !       +--] [--+
     !
 91  ! RESET   LARMD
     !    0      67     161                                            163
     !--] [--+--] [--+--] [--+------------------------------------( )--
     !
 92  !
     !  163            +-----+                                         164
     !--] [--+-------! TRD !-+------------------------------------( )--
     !                !     !
     !                !     !
     !  163           !     !
     !--] [--+-------! RST ! PRS  2.0
     !                !     ! ACC   .0
     !                !     !
     !                !     !
     !                !     !
     !                +-----+
     !
 93  !
     !  164            +-----+                                         165
     !--] [--+-------! TRD !-+------------------------------------( )--
     !                !     !
     !                !     !
     !  164           !     !
     !--] [--+-------! RST ! PRS  9.0
     !                !     ! ACC   .0
     !                !     !
     !                !     !
     !                !     !
     !                +-----+
     !
```

```
LINE
NUMBER
 94   :
      :  164      165                                                LRWND
      :--] [--+--]/[--+-------------------------------------------( )--
      :                                                              51
 95   :
      :  165            +------+
      :--] [--+--------: TRD :-+-------------------------------------( )--
      :                 :      :                                     166
      :                 :      :
      :  165            :      :
      :--] [--+--------: RST :  PRS  2.0
      :                 :      :  ACC    .0
      :                 :      :
      :                 :      :
      :                 :      :
      :                 +------+
      :
 96   :  RESET   LINDX            LARMU   LARMD
      :    0       23     170      43      49                        167
      :--] [--+--] [--+--]/[--+--]/[--+--]/[--+-------------------( )--
      :        :        :
      :        :        :
      :        :  167   :
      :        +--] [--+
      :        :        :
      :        :        :
      :        :  166   :
      :        +--] [--+
      :
 97   :                                                              LCONF
      :  167      169                                                 53
      :--] [--+--]/[--+-------------------------------------------( )--
      :
 98   :
      :  167            +------+
      :--] [--+--------: TRD :-+-------------------------------------( )--
      :                 :      :                                     168
      :                 :      :
      :  167            :      :
      :--] [--+--------: RST :  PRS  5.0
      :                 :      :  ACC    .0
      :                 :      :
      :                 :      :
      :                 :      :
      :                 +------+
      :
 99   :                                                              LCOND
      :  168                                                          55
      :--] [--+-------------------------------------------------( )--
      :
100   :
      :  168            +------+
      :--] [--+--------: TRD :-+-------------------------------------( )--
      :                 :      :                                     169
      :                 :      :
      :  167            :      :
      :--] [--+--------: RST :  PRS  3.0
      :                 :      :  ACC    .0
      :                 :      :
      :                 :      :
      :                 :      :
      :                 +------+
      :
```

```
LINE
NUMBER
 101  !
      !  169            +------+                                        170
      !--] [--+-------! TRO !-+-----------------------------------( )--
      !                 !      !
      !                 !      !
      !  167            !      !
      !--] [--+-------! RST ! PRS  5.0
      !                 !      ! ACC   .0
      !                 !      !
      !                 !      !
      !                 !      !
      !                 +------+
      !
 102  ! RESET   LINDX   LARMU   LARMD
      !    0      23      43      49     172                           171
      !--] [--+--] [--+--]/[--+--]/[--+--]/[--+-----------------( )--
      !        !        !
      !        !        !
      !        !  171   !
      !        +--] [--+
 103  !
      !  171            +------+                                        172
      !--] [--+-------! TRO !-+-----------------------------------( )--
      !                 !      !
      !                 !      !
      !  171            !      !
      !--] [--+-------! RST ! PRS 20.0
      !                 !      ! ACC   .0
      !                 !      !
      !                 !      !
      !                 !      !
      !                 +------+
      !
 104  ! RESET
      !    0     170     171                                           173
      !--] [--+--] [--+--]/[--+-----------------------------------( )--
      !
 105  ! LARMD   2CYLT
      !   49     160     178                                           174
      !--]/[--+--] [--+--]/[--+-----------------------------------( )--
      !                 !
      !          RESET !
      !  174        0  !
      !--] [--+--] [--+
      !
 106  !                                                              DISTF
      !                                                                80
      !-----------------------------------------------------------( )--
      !
 107  ! RESET   LARMU
      !    0      14     178                                           175
      !--] [--+--] [--+--]/[--+-----------------------------------( )--
      !        !        !
      !        !        !
      !        !  175   !
      !        +--] [--+
      !
 108  ! RESET   LARMU
      !    0      14     175     174                                   176
      !--] [--+--] [--+--] [--+--] [--+-------------------------( )--
      !        !        !
      !        !        !
      !        !  176   !
      !        +--] [--+
```

```
LINE
NUMBER
 109  !
      !  176            +-----+                                    177
      !--] [--+-------! TRO !-+-----------------------------------( )--
      !                !     !
      !                !     !
      !  176           !     !
      !--] [--+-------! RST ! PRS  2.0
      !                !     ! ACC   .0
      !                !     !
      !                !     !
      !                !     !
      !                +-----+
      !
 110  !
      !  177            +-----+                                    178
      !--] [--+-------! TRO !-+-----------------------------------( )--
      !                !     !
      !                !     !
      !  177           !     !
      !--] [--+-------! RST ! PRS  2.0
      !                !     ! ACC   .0
      !                !     !
      !                !     !
      !                !     !
      !                +-----+
      !
 111  ! RARMU                                                     TRANS
      !   42                                                        62
      !--] [--+-----------------------------------------------------( )--
      !       !
      ! RARMD !
      !   48  !
      !--] [--+
      !       !
      ! LARMU !
      !   43  !
      !--] [--+
      !       !
      ! LARMD !
      !   49  !
      !--] [--+
      !
 112  ! ANALG
      !   87                                                       230
      !--[D]--+-----------------------------------------------------(S)--
      !    0                                                         0
      !
 113  ! T11CR
      !   41
      !--] [--+-----------------------------------------------------SKP--
      !                                                             1
      !
 114  !                                                            RFF
      !                                                            31
      !-----------------------------------------------------------( )--
      !
 115  ! T11CR
      !   41
      !--]/[--+----------------------------------------------------SKP--
      !                                                             1
      !
```

```
LINE
NUMBER
 116  !                                                                  LFF
      !                                                                  83
      !-----------------------------------------------------------------( )--
      !
 117  !
      !  200      189                                                   182
      !--] [--+--]/[--+-----------------------------------------------( )--
      !       !
      !       !
      !  182  !
      !--] [--+
      !
 118  !
      !  182            +-----+                                         183
      !--] [--+-------! TRD !-+-----------------------------------( )--
      !                 !     !
      !                 !     !
      !  182            !     !
      !--] [--+-------! RST ! PRS  120
      !                 !     ! ACC    0
      !                 !     !
      !                 !     !
      !                 !     !
      !                 +-----+
      !
 119  ! RCLMP                                                          TMALF
      !   15      183                                                    59
      !--] [--+--] [--+-----------------------------------------------( )--
      !       !
      ! LCLMP !
      !   16  !
      !--] [--+
      !
 120  ! ANALG
      !   87                                                            240
      !--[D]--+-----------------------------------------------------(S)--
      !    0                                                              0
      !
 121  ! T11CR
      !   41
      !--] [--+-----------------------------------------------------SKP--
      !                                                                  1
      !
 122  !                                                                 RBF
      !                                                                 82
      !-----------------------------------------------------------------( )--
      !
 123  ! T11CR
      !   41
      !--]/[--+-----------------------------------------------------SKP--
      !                                                                  1
      !
 124  !                                                                 LBF
      !                                                                 84
      !-----------------------------------------------------------------( )--
      !
 125  !   RUN    TMALF    RMODE
      !    1      59      105                                           187
      !--] [--+--] [--+--] [--+-----------------------------------( )--
      !       !                !
      !       !                !
      !       !  187           !
      !       +--] [----------+
```

```
LINE
NUMBER
       :
 126   : RMODE
       :  105      187                                          188
       :--] [--+--]/[--+-------------------------------------( )--
       :
 127   : RCLMP   LDRVE
       :   15      32      183                                  189
       :--]/[--+--] [--+--] [--+-----------------------------( )--
       :                   :
       : LCLMP   RDRVE :
       :   16      33  :
       :--]/[--+--] [--+
       :
 128   : ANALG
       :   87                                                   250
       :--[D]--+-------------------------------------------(S)--
       :    0                                                    0
       :
 129   :
       :  230              240                                  190
       :--[B]--+--]G[--+--[B]--+-----------------------------( )--
       :    0                0
       :
 130   :                                                       REVFF
       :  190                                                    72
       :--] [----------+-------------------------------------( )--
       :               :
       :               :
       :  199     192  :
       :--] [--+--]/[--+
       :               :
       :               :
       :  194     192  :
       :--] [--+--]/[--+
       :
 131   :
       :  250              230                                  191
       :--[B]--+--]G[--+--[B]--+-----------------------------( )--
       :    0                0
       :
 132   :                                                       REVBF
       :  191                                                    73
       :--] [----------+-------------------------------------( )--
       :               :
       :               :
       :  194     192  :
       :--] [--+--] [--+
       :
 133   :
       :  190     191                                          192
       :--] [--+--]/[--+-------------------------------------( )--
       :       :
       :       :
       :  192  :
       :--] [--+
       :
```

```
LINE
NUMBER
 134  !  DREV
      !   20            +-----+                                          193
      !--] [--+--------! TRO !-+-----------------------------------( )--
      !                !     !
      !  DREV          !     !
      !   20           !     !
      !--] [--+--------! RST ! PRS    .1
      !                !     ! ACC    .0
      !                !     !
      !                !     !
      !                !     !
      !                +-----+
      !
 135  !  DREV
      !   20      193                                                  194
      !--] [--+--]/[--+-----------------------------------------------( )--
      !
 136  ! DTEST
      !   19
      !--]/[--+-------------------------------------------------------SKP--
      !       !                                                          3
      !   RUN !
      !    1  !
      !--] [--+
      !
 137  !
      !  230
      !--[B]--+--]G[--+--[K]--+-------------------------------------( )--
      !    0              128                                          195
      !
 138  !
      !                    230
      !--[K]--+--]G[--+--[B]--+-------------------------------------( )--
      !  128                 0                                         196
      !
 139  !                                                                DMID
      !  195      196                                                   61
      !--] [--+--] [--+-----------------------------------------------( )--
      !
 140  ! DTEST                                                          DISON
      !   19                                                            56
      !--] [--+-------------------------------------------------------( )--
      !       !
      !   RUN !
      !    1  !
      !--] [--+
      !
 141  ! MANCT
      !  103                                                            197
      !--] [--+-------------------------------------------------------( )--
      !       !
      ! 2PRST !
      !   65  !
      !--] [--+
      !
```

```
LINE
NUMBER
 142  !
      !  197            +-----+                                    198
      !--] [--+--------! TRD !-+-----------------------------------( )--
      !                !     !
      !                !     !
      !  197           !     !
      !--] [--+--------! RST ! PRS    .1
      !                !     ! ACC    .0
      !                !     !
      !                !     !
      !                !     !
      !                +-----+
      !
 143  !
      !  197     198                                                199
      !--] [--+--]/[--+-----------------------------------------------( )--
      !
 144  !                                                            DHISP
      !  199     200                                                 57
      !--] [--+--]/[--+-----------------------------------------------( )--
      !       !
      ! DHISP !
      !   57  !
      !--] [--+
      !
 145  ! DHISP
      !   57     191     201                                        200
      !--] [--+--] [--+--]/[--+-----------------------------------( )--
      !               !
      !               !
      !  200          !
      !--] [----------+
      !
 146  ! DTEST   DHISP     RUN                                      DTEST
      !   19      57       1                                        60
      !--] [--+--]/[--+--]/[--+-----------------------------------( )--
      !
 147  !
      !  200           +-----+                                    201
      !--] [--+--------! TRD !-+-----------------------------------( )--
      !                !     !
      !                !     !
      !  200           !     !
      !--] [--+--------! RST ! PRS    .1
      !                !     ! ACC    .0
      !                !     !
      !                !     !
      !                !     !
      !                +-----+
      !
 148  !
      !  200     205                                                204
      !--] [--+--]/[--+-----------------------------------------------( )--
      !       !
      !       !
      !  204  !
      !--] [--+
      !
```

```
LINE
NUMBER

149  :
     :  204              +-------+                                    205
     :--] [--+----------: TRD :-+-----------------------------------( )--
     :                   :       :
     :                   :       :
     :  204              :       :
     :--] [--+----------: RST : PRS    .3
     :                   :       : ACC    .0
     :                   :       :
     :                   :       :
     :                   :       :
     :                   +-------+
     :
150  :
     :  200      207                                                 206
     :--] [--+--]/[--+-------------------------------------------( )--
     :       :
     :       :
     :  206  :
     :--] [--+
     :
151  :
     :  206              +-------+                                    207
     :--] [--+----------: TRD :-+-----------------------------------( )--
     :                   :       :
     :                   :       :
     :  206              :       :
     :--] [--+----------: RST : PRS    .4
     :                   :       : ACC    .0
     :                   :       :
     :                   :       :
     :                   :       :
     :                   +-------+
     :
152  :
     :
     :-------------------------------------------------------------SKP--
     :                                                                0
     :
```

2048 = MEMORY SIZE
1598 = WORDS USED
450 = WORDS UNUSED

APPENDIX III

GLOSSARY OF FUNCTION DEFINITIONS

I/O ADDRESS

0 RESET—Relay contacts denoting take-up apparatus not in emergency stop condition (fail safe system)

1 RUN—Relay contacts denoting that the insulating line is in operation (reponsive to numerous line conditions and operator-controlled "ON" push button)

2 MACUT—Manual operation of full cutover cycle transferring strand from one reel to the other (manual push button operated)

3 CARFR—Distributor carriage is located at a far-right position beyond right reel (limit switch operated)

4 CARFL—Distributor carriage is located at a far-left position beyond left reel (limit switch operated)

5 CAORR—Distributor carriage is located over right reel (limit switch operated)

6 CARFL—Distributor carriage is located at a far-left position beyond left reel (limit switch operated)

7 CAOLR—Distributor carriage is located over left reel (limit switch operated)

8 CARFR—Distributor carriage is located at a far-right position beyond right reel (limit switch operated)

9 MANUR—Manually-initiated unloading of right reel from take-up apparatus (manual push button operation)

10 RSHRD—Shroud located at forward position adjacent back flange of right reel (limit switch operated)

11 MANUL—Manually-initiated unloading of left reel from take-up apparatus (manual push button operation)

12 LSHRD—Shroud located at forward position adjacent back flange of left reel (limit switch operated)

13 RARMU—Right reel lift arm in "up" position (limit switch operated)

14 LARMU—Left reel lift arm in "up" position (limit switch operated)

15 RCLMP—Right reel clamp in clamping position (limit switch operated)

16 LCLMP—Left reel clamp in clamping position (limit switch operated)

17 RARMD—Right reel lift arm in "down" position (limit switch operated)

18 LARMD—Left reel lift arm in "down" position (limit switch operated)

19 DTEST—Manually-initiated testing of operation of distributor (manual selector switch)

20 DREV—Manually-initiated reversal of distributor (manual push button)

21 RINDX—Manually-initiated indexing of right reel conveyor (manual push button)

23 LINDX—Manually-initiated indexing of left reel conveyor (manual push button)

27 RLOAD—Manually-initiated loading of right reel into take-up apparatus (manual push button)

29 LLOAD—Manually-initiated loading of left reel into take-up apparatus (manual push button)

30 LRSET—Manually-initiated return of reel lift arm to "down" position (manual push button)

31 1PRST—Footage of strand passing footage counter equals first count preset in counter (relay contact)

32 LDRVE—Turns on drive for left reel motor

33 RDRVE—Turns on drive motor for right reel

35 CUTOV—Provides indication that cutover of carriage and distributor has occurred 36 CARRL—Provides control for air cylinder to move carriage from right to left 37 CARRR—Provides control for air cylinder to move carriage from left to right 38 RSHRD—Provides control for air cylinder to move shroud adjacent back flange of right reel 39 LSHRD—Provides control for air cylinder to move shroud adjacent back flange of left reel 40 CTARM—Provides control for air cylinder to move cutover arm forcing strand into snagger associated with empty reel 41 T11CR—Provides control to alternately connect tachometer outputs to distributor control circuit and to select operating mode of take-up drives (dancer position follower and speed follower)

42 RARMU—Provides control for stepper motor to raise lift arm for right reel to "up" position 43 LARMU—Provides control for stepper motor to raise lift arm for left reel to "up" position 44 RUNCL—Provides control for air cylinder to withdraw clamp from right reel during unloading procedure 45 LUNCL—Provides control for air cylinder to withdraw clamp from left reel during unloading procedures 46 RPUSH—Provides control for air cylinder to push unloaded right reel onto raised lift arm 47 LPUSH—Provides control for air cylinder to push unloaded left reel onto raised lift arm 48 RARMD—Provides control for stepper motor to move right reel lift arm to the "down" position 49 LARMD—Provides control for stepper motor to move left reel lift arm to the "down" position 50 RRWND—Provides control to rotate unloaded full right reel to insure that strand tail is wound onto right reel 51 LRWND—Provides control to rotate unloaded full left reel to insure that strand tail is wound onto left reel 52 RCONF—Provides control to move unloaded full right reel one space on conveyor 53 LCONF—Provides control to move unloaded full left reel one space on conveyor 54 RCOND—Provides control to move the conveyor containing the unloaded full right reel to a "down" position 55 LCOND—Provides control to move the conveyor containing the unloaded full left reel to a "down" position 56 DISON—Turns on distributor drive 57 DHISP—Operates distributor drive at high speed 58 TREDY—Provides indication to insulating line that take-up apparatus is ready for operation 59 TMALF—Provides indication of malfunction of take-up apparatus 60 DTEST—Facilitates operation of distributor drive for maintenance test 61 DMID—Provides control of lamp to indicate that distributor is at midpoint between front and back flanges of reel 62 TRANS—Turns on lift arm stepper motor translator
65 2PRST—Footage of strand passing footage counter equals second count preset in counter
66 RARMD—Right reel lift arm in "down" position (limit switch operated)
67 LARMD—Left reel lift arm in "down" position (limit switch operated)
68 RARMU—Right reel lift arm in "up" position (limit switch operated)
69 LARMU—Left reel lift arm in "up" position (limit switch operated)
70 ARMSP—Manually-initiated stop control for either lift arm
71 RRSET—Manually-initiated control to lower right lift arm
72 REVFF—Change of D.C. potential to distributor control circuit to reverse direction of distributor at front flange of reel
73 REVBF—Change of D.C. potential to distributor control circuit to reverse direction of distributor at back flange of reel
80 DISTF—Development of digital signal in response to application of varying analog voltage to controller representing instantaneous position of distributor
81 RFF—Development of digital signal in response to application of preset analog voltage to controller representing front flange of right reel
82 RBF—Development of digital signal in response to application of preset analog voltage to controller representing back flange of right reel
83 LFF—Development of digital signal in response to application of preset analog voltage to controller representing front flange of left reel
84 LBF—Development of digital signal in response to application of preset analog voltage to controller representing back flange of left reel
87 ANALG—Internal facility of controller for transferring data from analog card to data bus

What is claimed is:

1. A system for controlling the movement of a reciprocating mechanism between spaced end-points along a path of travel of the mechanism, which comprises:
- means for driving the reciprocating mechanism;
- means responsive to movement of the driving means for developing a voltage signal of varying instantaneous levels representative of instantaneous positions of the reciprocating mechanism along the path of travel thereof;
- means for establishing a pair of voltage signals at selected levels representative of respective end-points of travel of the reciprocating mechanism;
- means responsive to the coincidence of the instantaneous voltage signal and one of the pair of the end-point signals for developing a reversal signal; and
- means for applying the reversal signal to the driving means to reverse the direction of travel of the reciprocating mechanism.

2. The system as set forth in claim 1, wherein the instantaneous voltage signal developing means includes a potentiometer having a wiper portion movable with the driving means for developing a voltage signal of varying instantaneous levels representative of the instantaneous positions of the reciprocating mechanism along the path of travel thereof.

3. The system as set forth in claim 1, wherein the voltage level establishing means includes a pair of potentiometers for establishing voltage signals representative of respective ones of the end-points of travel of the reciprocating mechanism.

4. The system as set forth in claim 1, wherein the voltage signals of the voltage-signal developing means and the establishing means are analog voltage signals and the reversal-signal developing means includes:
- means for converting to digital voltage signals, the analog voltage signals of the voltage-signal developing means and the establishing means; and
- means for comparing the digital voltage signals to develop a reversal signal upon the coincidence of the digital signal associated with the driving means and either of the digital signals associated with the end-points of travel.

5. A system for controlling the movement of a reciprocating mechanism between spaced end-points along a path of travel of the mechanism whereby the mechanism guides material onto a take-up unit comprising:
- means for driving the reciprocating mechanism;
- first controlling means for controlling the driving means to move the reciprocating mechanism between spaced end-points of travel at a given speed;
- means responsive to the take up of a preselected amount of material onto the unit for developing a preselected-amount voltage signal indicative of the take up of the preselected amount; and
- second controlling means responsive to the developed preselected-amount voltage signal for controlling the drive means to move the reciprocating mechanism toward a selected one of the end-points of travel at a speed higher than the given speed.

6. A system as set forth in claim 5 wherein the first controlling means includes:
- means for generating a high-level voltage signal;
- means responsive to the high-level voltage signal for developing a pulse signal of a given frequency; and
- means responsive to the pulse signal and the given frequency thereof for controlling the driving means to move the reciprocating mechanism at the given speed.

7. A system as set forth in claim 6 wherein the second controlling means includes:
- means responsive to the development of the preselected-amount voltage signal for ceasing the generation of the high-level voltage signal;
- means responsive to the development of the preselected-amount voltage signal for controlling the pulse signal developing means to develop a second pulse signal at a frequency higher than the given frequency; and
- means responsive to the second pulse signal and the higher frequency thereof for controlling the driving means to move the reciprocating mechanism at the higher speed.

8. A system as set forth in claim 5 or 7 wherein the reciprocating mechanism is traveling in a direction away from the selected one of the end-points of travel, which further comprises:
- means responsive to the development of the preselected-amount voltage signal for controlling the driving means to immediately reverse the direction of travel of the reciprocating mechanism and thereby move the mechanism toward the selected end-point of travel.

9. A system for controlling the movement of a reciprocating mechanism between spaced end-points along a path of travel of the mechanism, which comprises:

means for driving the reciprocating mechanism;

a position-feedback potentiometer having a wiper portion movable with the driving means for developing an analog voltage signal of varying instantaneous levels representative of the instantaneous positions of the reciprocating mechanism along the path of travel thereof;

a pair of end-point potentiometers for establishing analog voltage signals representative of respective ones of the spaced end-points of travel of the reciprocating mechanism;

means for converting to digital voltage signals, the analog voltage signals developed through the position-feedback potentiometer and the pair of end-point potentiometers;

means responsive to the coincidence of the digital voltage signal associated with the instantaneous position of the reciprocating mechanism and either of the digital voltage signals associated with the respective end-points of travel of the mechanism to develop a mechanism-reversal signal; and means for applying the mechanism-reversal signal to the driving means to reverse the direction of travel of the reciprocating mechanism.

10. The system as set forth in claim 9, wherein the reciprocating mechanism guides material onto a take-up unit, which further comprises:

means for generating a high-level voltage signal means responsive to the high-level voltage signal for developing a first pulse signal of a first frequency;

means responsive to the first pulse signal and the first frequency thereof for controlling the driving means to move the reciprocating mechanism at a given speed;

means responsive to the take up of a preselected amount of material onto the unit for developing a preselected-amount voltage signal indicative of the take up of the preselected amount;

means responsive to the development of the preselected-amount voltage signal for controlling the generating means to cease generation of the high-level voltage signal;

means responsive to the development of the preselected-amount voltage signal for controlling the pulse signal developing means to develop a second pulse signal at a frequency higher than the first frequency; and means responsive to the second pulse signal and the higher frequency thereof for controlling the driving means to move the reciprocating mechanism toward a selected one of the end-points of travel at a speed higher than the given speed.

11. The system as set forth in claim 10 where the reciprocating mechanism is traveling in a direction away from a selected one of the end-points of travel, which further comprises:

means responsive to the development of the preselected-amount voltage signal for controlling the driving means to immediately reverse the direction of travel of the reciprocating mechanism and thereby move the mechanism toward the selected end-point of travel.

* * * * *

UNITED STATES PATENT AND TRADEMARK OFFICE

CERTIFICATE OF CORRECTION

PATENT NO. : 4,283,020

DATED : August 11, 1981

INVENTOR(S) : W. A. Bauer, C. R. Frohlich, Jr., R. H. Griffin, J. G. Henderson

It is certified that error appears in the above-identified patent and that said Letters Patent are hereby corrected as shown below:

Columns 53 and 54, after "450 * WORDS UNSUSED" add the attached sheets.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*

REF #401011

APPENDIX II

I/O ADDRESS LISTING

I/O
ADDRESS LINE NUMBER (♦DENOTES OUTPUT)

| | | | | | | | | | | |
|---|---|---|---|---|---|---|---|---|---|---|
| 0 | RESET | 2 | 3 | 4 | 6 | 7 | 9 | 10 | 11 | 13 |
| | | 15 | 17 | 19 | 20 | 22 | 24 | 25 | 26 | 28 |
| | | 29 | 30 | 37 | 38 | 39 | 40 | 42 | 43 | 43 |
| | | 44 | 47 | 49 | 50 | 51 | 52 | 53 | 58 | 64 |
| | | 66 | 67 | 68 | 69 | 72 | 73 | 74 | 76 | 77 |
| | | 78 | 80 | 81 | 81 | 82 | 85 | 87 | 88 | 89 |
| | | 90 | 91 | 96 | 102 | 104 | 105 | 107 | 108 | |
| 1 | RUN | 4 | 6 | 7 | 9 | 10 | 11 | 13 | 15 | 17 |
| | | 19 | 20 | 22 | 25 | 26 | 30 | 38 | 39 | 72 |
| | | 73 | 74 | 76 | 77 | 125 | 136 | 140 | 146 | |
| 2 | MACUT | 6 | | | | | | | | |
| 3 | CARFR | 7 | 10 | 11 | 73 | 74 | 76 | | | |
| 4 | CARFL | 2 | 7 | 10 | 11 | 25 | 26 | 38 | | |
| 5 | CADRR | 2 | 3 | 24 | 72 | | | | | |
| 6 | CARFL | 24 | | | | | | | | |
| 7 | CADLR | 72 | | | | | | | | |
| 8 | CARFR | 72 | | | | | | | | |
| 9 | MANUR | 39 | | | | | | | | |
| 10 | RSHRD | 39 | | | | | | | | |
| 11 | MANUL | 77 | | | | | | | | |
| 12 | LSHRD | 77 | | | | | | | | |
| 13 | RARMU | 42 | 68 | 69 | | | | | | |
| 14 | LARMU | 80 | 107 | 108 | | | | | | |
| 15 | RCLMP | 3 | 4 | 6 | 10 | 43 | 43 | 44 | 49 | 50 |
| | | 119 | 127 | | | | | | | |
| 16 | LCLMP | 6 | 10 | 22 | 81 | 81 | 82 | 87 | 88 | 119 |
| | | 127 | | | | | | | | |
| 17 | RARMD | 37 | 47 | 52 | | | | | | |
| 18 | LARMD | 37 | 85 | 90 | | | | | | |
| 19 | DTEST | 136 | 140 | 146 | | | | | | |
| 20 | DREV | 134 | 134 | 135 | | | | | | |
| 21 | RINDX | 58 | 64 | | | | | | | |
| 23 | LINDX | 96 | 102 | | | | | | | |
| 27 | RLOAD | 37 | 40 | | | | | | | |
| 29 | LLOAD | 37 | 78 | | | | | | | |
| 30 | LRSET | 37 | 85 | 90 | | | | | | |
| 31 | 1FRST | 9 | | | | | | | | |
| 32 | LDRVE | 4 | 22 | 22♦ | 23 | 23 | 77 | 78 | 80 | 85 |
| | | 127 | | | | | | | | |
| 33 | RDRVE | 4 | 4♦ | 5 | 5 | 22 | 39 | 40 | 42 | 47 |
| | | 127 | | | | | | | | |
| 35 | CUTDV | 10♦ | 13 | 17 | 20 | | | | | |
| 36 | CARRL | 24♦ | | | | | | | | |
| 37 | CARRR | 72♦ | | | | | | | | |
| 38 | RSHRD | 38♦ | 76 | | | | | | | |
| 39 | LSHRD | 38 | 76♦ | | | | | | | |
| 40 | CTARM | 15 | 15♦ | 16 | 16 | 38 | 40 | 76 | 78 | |
| 41 | T11CR | 24 | 30 | 30♦ | 72 | 113 | 115 | 121 | 123 | |
| 42 | RARMU | 41♦ | 48 | 49 | 50 | 51 | 58 | 64 | 78 | 85 |
| | | 111 | | | | | | | | |

PAGE 2 REF #401011

I/O
ADDRESS LINE NUMBER (←DENOTES OUTPUT)

| | | | | | | | | | | |
|---|---|---|---|---|---|---|---|---|---|---|
| 43 | LARMU | 40 | 47 | 79← | 86 | 87 | 88 | 89 | 96 | 102 |
| | | 111 | | | | | | | | |
| 44 | RUNCL | 42 | 42← | | | | | | | |
| 45 | LUNCL | 80 | 80← | | | | | | | |
| 46 | RPUSH | 44← | | | | | | | | |
| 47 | LPUSH | 82← | | | | | | | | |
| 48 | RARMD | 41 | 47 | 48← | 49 | 50 | 58 | 64 | 67 | 78 |
| | | 85 | 111 | | | | | | | |
| 49 | LARMD | 40 | 47 | 79 | 85 | 86← | 87 | 88 | 96 | 102 |
| | | 105 | 111 | | | | | | | |
| 50 | RRWND | 56← | | | | | | | | |
| 51 | LRWND | 94← | | | | | | | | |
| 52 | RCONF | 40 | 51 | 59← | | | | | | |
| 53 | LCONF | 78 | 89 | 97← | | | | | | |
| 54 | RCOND | 61← | | | | | | | | |
| 55 | LCOND | 99← | | | | | | | | |
| 56 | DISON | 140← | | | | | | | | |
| 57 | DHISP | 144 | 144← | 145 | 146 | | | | | |
| 58 | TREDY | 3 | 3← | | | | | | | |
| 59 | TMALF | 119← | 125 | | | | | | | |
| 60 | DTEST | 146← | | | | | | | | |
| 61 | DMID | 139← | | | | | | | | |
| 62 | TRANS | 111← | | | | | | | | |
| 65 | 2PRST | 141 | | | | | | | | |
| 66 | RARMD | 53 | | | | | | | | |
| 67 | LARMD | 91 | | | | | | | | |
| 68 | RARMU | 39 | 41 | | | | | | | |
| 69 | LARMU | 77 | 79 | | | | | | | |
| 70 | ARMSP | 37 | | | | | | | | |
| 71 | RRSET | 37 | 47 | 52 | | | | | | |
| 72 | REVFF | 130← | | | | | | | | |
| 73 | REVBF | 132← | | | | | | | | |
| 80 | DISTF | 106← | | | | | | | | |
| 81 | RFF | 114← | | | | | | | | |
| 82 | RBF | 122← | | | | | | | | |
| 83 | LFF | 116← | | | | | | | | |
| 84 | LBF | 124← | | | | | | | | |
| 87 | ANALG | 112 | 120 | 128 | | | | | | |
| 100 | CAPDS | 2 | 2← | 24 | 72 | 72 | | | | |
| 101 | MANCT | 6 | 6← | 7 | 9 | 25 | 73 | | | |
| 102 | | 7← | 8 | 8 | | | | | | |
| 103 | MANCT | 8← | 141 | | | | | | | |
| 104 | RARMU | 40← | 41 | | | | | | | |
| 105 | RMODE | 9 | 9← | 125 | 126 | | | | | |
| 106 | CPULS | 11 | 11 | 11← | 12 | 12 | 24 | 72 | | |
| 107 | OFF | 11 | 12← | | | | | | | |
| 108 | CPULS | 4 | 13 | 13← | 14 | 14 | 15 | 22 | 28 | 29 |
| 109 | OFF | 13 | 14← | | | | | | | |
| 110 | OFF | 15 | 16← | | | | | | | |
| 111 | | 17 | 17← | 18 | 18 | | | | | |
| 112 | | 18← | 19 | | | | | | | |
| 113 | | 4 | 4 | 17 | 19 | 19← | 20 | 22 | 22 | 28 |
| | | 29 | | | | | | | | |
| 114 | | 20 | 20← | 21 | 21 | | | | | |
| 115 | | 19 | 21← | | | | | | | |
| 116 | | 25 | 25← | 72 | | | | | | |
| 117 | | 26← | 27 | 27 | | | | | | |

PAGE 3 REF #401011

| I/O ADDRESS | LINE NUMBER (•DENOTES OUTPUT) | | | | | | | |
|---|---|---|---|---|---|---|---|---|
| 118 | 25 | 27• | | | | | | |
| 119 | 28• | 29 | 30 | 31 | | | | |
| 120 | 28 | 29• | 30 | 34 | | | | |
| 121 | 31 | 31• | 32 | 32 | | | | |
| 122 | 4 | 32• | 33 | 33 | | | | |
| 123 | 31 | 33• | | | | | | |
| 124 | 34 | 34• | 35 | 35 | | | | |
| 125 | 22 | 35• | 36 | 36 | | | | |
| 126 | 34 | 36• | | | | | | |
| 127 ARMSP | 37 | 37• | 39 | 47 | 77 | 85 | | |
| 128 | 39 | 39• | 40 | | | | | |
| 129 | 43• | 44 | 45 | 45 | 46 | | | |
| 130 | 45• | 46 | | | | | | |
| 131 | 46• | 47 | | | | | | |
| 132 1CYRT | 49 | 49• | 51 | | | | | |
| 133 2CYRT | 50 | 50• | 67 | | | | | |
| 134 | 51 | 51• | 53 | | | | | |
| 135 | 51 | 52 | 52• | | | | | |
| 136 | 53• | 54 | 54 | | | | | |
| 137 | 54• | 55 | 55 | 56 | | | | |
| 138 | 55• | 56 | 57 | 57 | | | | |
| 139 | 57• | 58 | | | | | | |
| 140 | 58 | 58• | 59 | 60 | 60 | 62 | 63 | |
| 141 | 60• | 61 | 62 | | | | | |
| 142 | 59 | 62• | 63 | | | | | |
| 143 | 58 | 63• | 66 | | | | | |
| 144 | 64 | 64• | 65 | 65 | 66 | | | |
| 145 | 64 | 65• | | | | | | |
| 146 | 39 | 66• | | | | | | |
| 147 | 67 | 67• | 69 | | | | | |
| 148 | 68 | 68• | 69 | | | | | |
| 149 | 42 | 69 | 69• | 70 | 70 | | | |
| 150 | 47 | 70• | 71 | 71 | | | | |
| 151 | 67 | 68 | 71• | | | | | |
| 152 | 24 | 73 | 73• | | | | | |
| 153 | 74• | 75 | 75 | | | | | |
| 154 | 73 | 75• | | | | | | |
| 155 | 77 | 77• | 78 | | | | | |
| 156 | 81• | 82 | 83 | 83 | 84 | | | |
| 157 | 83• | 84 | | | | | | |
| 158 | 84• | 85 | | | | | | |
| 159 1CYLT | 87 | 87• | 89 | | | | | |
| 160 2CYLT | 98 | 88• | 105 | | | | | |
| 161 | 89 | 89• | 91 | | | | | |
| 162 | 89 | 90 | 90• | | | | | |
| 163 | 91• | 92 | 92 | | | | | |
| 164 | 92• | 93 | 93 | 94 | | | | |
| 165 | 93• | 94 | 95 | 95 | | | | |
| 166 | 95• | 96 | | | | | | |
| 167 | 96 | 96• | 97 | 98 | 98 | 100 | 101 | |
| 168 | 98• | 99 | 100 | | | | | |
| 169 | 97 | 100• | 101 | | | | | |
| 170 | 96 | 101• | 104 | | | | | |
| 171 | 102 | 102• | 103 | 103 | 104 | | | |
| 172 | 102 | 103• | | | | | | |
| 173 | 77 | 104• | | | | | | |
| 174 | 105 | 105• | 108 | | | | | |

PAGE 4 REF #401011

I/O
ADDRESS LINE NUMBER (←DENOTES OUTPUT)

| | | | | | | | | | | |
|---|---|---|---|---|---|---|---|---|---|---|
| 175 | | 107 | 107← | 108 | | | | | | |
| 176 | | 80 | 108 | 108← | 109 | 109 | | | | |
| 177 | | 85 | 109← | 110 | 110 | | | | | |
| 178 | | 105 | 107 | 110← | | | | | | |
| 179 | LARMU | 78← | 79 | | | | | | | |
| 182 | | 117 | 117← | 118 | 118 | | | | | |
| 183 | | 118← | 119 | 127 | | | | | | |
| 187 | | 3 | 125 | 125← | 126 | | | | | |
| 188 | | 4 | 6 | 22 | 24 | 39 | 72 | 77 | 126← | |
| 189 | | 117 | 127← | | | | | | | |
| 190 | | 129← | 130 | 133 | | | | | | |
| 191 | | 131← | 132 | 133 | 145 | | | | | |
| 192 | | 130 | 130 | 132 | 133 | 133← | | | | |
| 193 | | 134← | 135 | | | | | | | |
| 194 | | 130 | 132 | 135← | | | | | | |
| 195 | | 137← | 139 | | | | | | | |
| 196 | | 138← | 139 | | | | | | | |
| 197 | | 141← | 142 | 142 | 143 | | | | | |
| 198 | | 142← | 143 | | | | | | | |
| 199 | | 130 | 143← | 144 | | | | | | |
| 200 | | 6 | 11 | 117 | 144 | 145 | 145← | 147 | 147 | 148 |
| | | 150 | | | | | | | | |
| 201 | | 145 | 147← | | | | | | | |
| 202 | RARMD | 47← | 48 | | | | | | | |
| 203 | LARMD | 85← | 86 | | | | | | | |
| 204 | | 10 | 148 | 148← | 149 | 149 | | | | |
| 205 | | 148 | 149← | | | | | | | |
| 206 | | 9 | 150 | 150← | 151 | 151 | | | | |
| 207 | | 150 | 151← | | | | | | | |
| 208 | | 5← | 42 | | | | | | | |
| 209 | | 23← | 80 | | | | | | | |
| 230 | | 112← | 129 | 131 | 137 | 138 | | | | |
| 240 | | 120← | 129 | | | | | | | |
| 250 | | 128← | 131 | | | | | | | |
| 255 | TEST | 1 | 1← | | | | | | | |